US006797021B2

(12) United States Patent
Puri et al.

(10) Patent No.: US 6,797,021 B2
(45) Date of Patent: Sep. 28, 2004

(54) PROCESS OF PREPARATION OF NOVEL MANNICH BASES FROM HYDROGENATED AND DISTILLED CASHEW NUT SHELL LIQUID (CNSL) FOR USE AS ADDITIVE IN LIQUID HYDROCARBON FUELS

(75) Inventors: Suresh Kumar Puri, Faridabad (IN); Anurag Ateet Gupta, Faridabad (IN); M. Rajesh, Faridabad (IN); Rameshwar Prasad, Faridabad (IN); V. K. Sharma, Faridabad (IN); M. Vanamamalai, Faridabad (IN); Ved Singh, Faridabad (IN); A. K. Misra, Faridabad (IN); Niranjan Raghunath Raje, New Delhi (IN); Som Prakash Srivastava, Haryana (IN); Akhilesh Bhatnagar, Faridabad (IN)

(73) Assignee: Indian Oil Corporation Limited, Maharashtra (IN)

( * ) Notice: Subject to any disclaimer, the term of this patent is extended or adjusted under 35 U.S.C. 154(b) by 84 days.

(21) Appl. No.: 09/900,608

(22) Filed: Jul. 6, 2001

(65) Prior Publication Data

US 2002/0066225 A1 Jun. 6, 2002

(30) Foreign Application Priority Data

Oct. 5, 2000 (IN) ..... 898/MUM/2000

(51) Int. Cl.[7] ..... C10L 1/22

(52) U.S. Cl. ..... 44/415; 508/542; 564/336

(58) Field of Search ..... 44/415; 508/542; 564/336

(56) References Cited

U.S. PATENT DOCUMENTS

| | | | | | |
|---|---|---|---|---|---|
| 2,962,442 | A | | 11/1960 | Andress | |
| 3,036,003 | A | | 5/1962 | Dolton, III | |
| 3,235,484 | A | | 2/1966 | Colfer | |
| 3,269,810 | A | | 8/1966 | Chamot | |
| 3,368,972 | A | | 2/1968 | Otto | |
| 3,502,451 | A | | 3/1970 | Moore et al. | |
| 3,539,633 | A | | 11/1970 | Piasek et al. | |
| 3,649,229 | A | | 3/1972 | Otto | |
| 4,038,044 | A | | 7/1977 | Garth | |
| 4,352,944 | A | * | 10/1982 | Tyman et al. | 568/750 |
| 4,395,498 | A | | 7/1983 | Benham | |
| 4,697,038 | A | * | 9/1987 | Tyman | 564/265 |
| 5,218,038 | A | | 6/1993 | Johnson et al. | |
| 5,433,774 | A | | 7/1995 | Kapl et al. | |
| 5,916,850 | A | * | 6/1999 | Tuli et al. | 508/353 |
| 6,339,052 | B1 | * | 1/2002 | Dohhen et al. | 508/436 |

* cited by examiner

*Primary Examiner*—Cephia D. Toomer
(74) *Attorney, Agent, or Firm*—Needle & Rosenberg, P.C.

(57) ABSTRACT

A process for the preparation of Mannich condensation products from hydrogenated and distilled Cashew Nut Shell Liquid, amines and aldehydes which provides improved detergency in the gasoline. Optionally, a polymeric dispersant, a non-volatile hydrocarbon carrier fluid and a solvent may be included for protecting and removing buildup of deposits on carburetor surfaces and intake valve system of a gasoline powered internal combustion engine

18 Claims, No Drawings

PROCESS OF PREPARATION OF NOVEL MANNICH BASES FROM HYDROGENATED AND DISTILLED CASHEW NUT SHELL LIQUID (CNSL) FOR USE AS ADDITIVE IN LIQUID HYDROCARBON FUELS

The present invention relates to a process of preparation of novel Mannich Bases from hydrogenated and distilled Cashew Nut Shell Liquid (CNSL) for use as additive in liquid hydrocarbon fuels for removing and protecting build up of deposits on carburetor surfaces and intake valve systems in a gasoline powered engine system.

BACKGROUND OF THE INVENTION

Typical middle distillate hydrocarbon fuels, boiling in the gasoline range and used in spark-ignition internal combustion (IC) engines often contain components, which possess low volatility or solubility in the fuels. In practice such components tend to form deposits in the fuel carburetion system where fuel vaporization occurs. Deposit accumulations on carburetor throttle body & plates and intake valves lead to progressively poorer engine performance such as improper or rough idling of the engine, excessive consumption of fuel and the increased level of hydrocarbons and partially burned fuel components in the exhaust gas. Chemicals, which prevent or eliminate deposits in carburetor and intake valve systems, contribute significantly not only to automotive efficiency and economy of operation but also to minimizing pollution of the environment.

Deposits thus accumulated may be removed periodically by physical cleaning during engine overhaul or tune-up. A more preferred option to the deposit problem requires no interruption of engine usage and this is usually accomplished in practice by inclusion of a chemical composition known as carburetor detergent additive in the gasoline fuel.

There is a growing need for a chemical or chemical composition possessing detergency properties such that carburetor deposits may be completely eliminated. The importance of this need is now emphasized by the widespread awareness of pollution problems and the desire to minimize the emission of pollutants from automotive exhaust systems.

As a thumb rule, carburetor detergent additives must be soluble in the hydrocarbon fuel composition and possess a suitable balance of lyophilize and hydrophilic properties. Addition of carburetor detergents usually result in alleviating the deposits problem, however, they may exhibit hydrophilic surface-active properties to such a degree that water suspension (haze) and emulsion formation may occur. Therefore, there is a need for a suitable carburetor detergent additive for automotive systems, which should be effective in removing and preventing deposits on carburetor surfaces while exhibiting no undesirable effects upon other properties of the gasoline.

Newer generation designs for automotive power units make provision for recycle of gases which contain some partially oxidized hydrocarbons having a tendency to form deposits at or near the intake valves. Accordingly, suitable detergent additives for use in automotive fuels must be capable of keeping intake valves clean. There is, therefore, also a need for a suitable intake valve detergent additive for automotive systems effective in removing and preventing deposits in the intake system while exhibiting no undesirable effects upon other properties of the hydrocarbon fuel. Ideally, a suitable detergent additive for use in gasoline range hydrocarbon fuel will provide and maintain a high degree of cleanliness in both carburetor and intake systems.

Polar grouping suitable for inclusion in oil-soluble surface-active agents is the basic amine grouping and a non-polar grouping for such agents is the alkylaryl group usually provided by alkylation of phenols. Such polar and non-polar groups may be conveniently brought together in one molecular by the well-known Mannich condensation reaction involving an alkyl phenol, a low molecular weight aldehyde and an amine.

The alkyl phenol used in the process is hydrogenated and distilled Cashew Nut Shell Liquid (popularly known as CNSL) obtained after the hydrogenation of naturally occurring, biodegradable, vegetable based Cashew Nut Shell Liquid. CNSL occurs as a reddish brown viscous liquid in the soft honeycomb structure of the shell of cashewnut. CNSL, extracted with low boiling petroleum ether, contains about 90% anacardic acid and about 10% cardol. CNSL, on distillation, gives the pale yellow phenolic derivatives, which are a mixture of biodegradable unsaturated m-alkylphenols, including cardanol. Catalytic hydrogenation of these phenols gives a white waxy material, predominantly rich in tetrahydroanacardol which is also known as hydrogenated CNSL.

CNSL and its derivatives have been known for producing high temperature phenolic resins and friction elements, as exemplified in U.S. Pat. Nos. 4,395,498 and 5,218,038. Friction lining production from CNSL is also reported in U.S. Pat. No. 5,433,774. Likewise, it is also known to form different types of friction materials, mainly for use in brake lining system of automobiles and coating resins from CNSL.

Mannich condensation reactions usually proceed with the formation of high molecular weight products, by linear growth due to the use of mono-substituted phenols and an amine groups. Excess aldehyde may also react with amine groups to form imines or hydroxymethylamines.

Accordingly, the properties of such polymeric compositions have principally been utilized in heavier fuels such as heating and furnace oils, as described in US. Pat. No. 2,962,442, and in lubricating oils, as disclosed in U.S. Pat. Nos. 3,036,003 and 3,539,633. None of these uses involves a sensitive carburetion system as is found in the gasoline-powered spark-ignition internal combustion system.

Mannich condensation products have often been employed as stabilizers, or antioxidants, as well as dispersants, or detergents, in heavy hydrocarbon stocks. Use in lighter hydrocarbon stocks such as gasolines, has been disclosed in U.S. Pat. Nos. 3,269,810 and 3,649,229. U.S. Pat. No. 3,235,484 (Now U.S. Pat. No. Re. 26,330) describes the addition of certain disclosed compositions to refinery hydrocarbon fuel stocks for the purpose of inhibiting the accumulation of carbonaceous deposits in refinery cracking units. The primary inhibitors disclosed are mixtures of amides, imides and amine salts formed by reacting an ethylene polyamine with hydrocarbon substituted succinic acids or anhydride, whose hydrocarbon substituaent has at least about 50 carbon atoms. As an adjunct for such primary carbonaceous deposit inhibitors there is disclosed in said patent Mannich condensation products formed by reacting (1) alkylphenol, (2) an amine and (3) formaldehyde in the ratio of one mole alkylphenol and from 0.1–10 mole each of formaldehyde and amine reactant.

U.S. Pat. No. 3,368,972 describes dispersant-detergent additive for lubricating oils as high molecular weight Mannich condensation products from (1) high molecular weight alkyl-substituted hydroxyaromatic compounds whose alkyl-substituent has a molecular weight in the range of 600–3000, (2) a compound containing at least one HN< group and (3)

an aldehyde in the respective molar ratio of 1.0:0.1–10:1.0–10.

The high molecular weight Mannich condensation products of either U.S. Pat. No. 3,235,484 or U.S. Pat. No. 3,368,972 have a drawback in their large-scale preparation and in their extended service used as lubricant addition agents used under high temperature conditions such as encountered in diesel engines. In the large-scale or plant preparation of such high molecular weight condensation products, especially in light mineral oil solvents, the resulting oil concentrate solution of the condensation product either has or develops during storage a haze which is believed to be caused by undissolved or borderline soluble by-products which not only are not substantially incapable of removal by filtration but also severely resurrect product filtration rate. When used in diesel engine crankcase lubricant oils and subject to high temperature in service use, piston ring groove carbonaceous deposits and skirt varnish tend to build up sufficiently rapidly and prevent desirable long in-service use of such lubricant oils.

A combination of diamine and higher polyamine Mannich condensation products useful in gasoline as carburetor detergents and useful also to control intake valve deposits and quick-heat intake manifold deposits has been disclosed in U.S. Pat. No. 4,038,044.

Various olefin polymers have been added to hydrocarbon fuels ranging from gasolines to diesel fuels to heavy oil fractions. Petrolatum have also been employed in gasolines. One example of such use of certain olefin polymers is described in U.S. Pat. No. 3,502,451, where gasoline motor fuel is claimed to be improved in its ability to maintain cleanliness of intake valves and parts.

The object of this invention is to provide a process for the preparation of novel Mannich bases from hydrogenated and distilled CNSL utilizing optimum reaction conditions of pressure temperature and proportion of all the reactants.

Another object of this invention is to propose a process for the preparation of Mannich bases from CNSL and their use as additive to improve gasoline fuels which shall be capable of substantially removing and protecting buildup of deposits on carburetor surfaces and intake valve system in a gasoline powered engine system.

To achieve the said objectives the present invention provides a process for the preparation of novel Mannich bases from hydrogenated and distilled Cashewnut Shell Liquid (CNSL) for use as additive in hydrocarbon fuels for removing and protecting build up of deposits on carburetor surfaces and intake valve systems in a gasoline powered engine system comprising:

reacting hydrogenated and distilled Cashew Nut Shell Liquid (CNSL), an amine having at least one reactive hydrogen atom, and an aldehyde in the molar ratio of 1:0.1 to 10:0.1 to 10 at a temperature ranging from 70° C.–175° C. for 6 to 12 hours in presence of an organic solvent, distilling said solvent and unreacted amine, and cooling and filtering the reaction product to obtain Mannich base The trace solvent and unreacted amine are distilled off under high vacuum at 140–150° C.

The said solvent is aprotic or protic solvents. Said protic solvent is alcohol and said aprotic solvent is selected from benzene, toluene, xylene or solvent-refined neutral oil.

The said amine is selected from the group consisting of primary and secondary alkyl/alkylaryl amines having an alkyl chain ranging from $C_1$ to $C_{20}$ or mixtures thereof preferably from $C_4$ to $C_8$.

The said amines include the mono and di-amino alkanes and their substituted analogs such as methylamine, ethylamine, dimethylamine, diethylamine, 2-ethylhexylamine, bis(2-ethylhexyl)amine, dimethylaminopropyl amine, diethanol amine, dipentyl amine, dicyclohexylamine, di-n butylamine; aromatic diamines, such as phenylene diamine, diamino naphthalenes; heterocyclic amines, e.g., morpholine, pyrrole, pyrrolidine, imidazole, imidazolidine, and piperidine; melamine and their substituted analogs.

The molar ratio of the reactants, Cashew Nut Shell Liquid (CNSL): an amine: an aldehyde is 1.0:1.0–1.2:1.0–1.2.

The said temperature at which the reaction is carried out is preferably 90° C.

The said aldehyde is an aliphatic aldehyde such as formaldehyde (including paraformaldehyde and Formalin) or formaldehyde yielding reactants, acetaldehyde and aldol (β-hydroxybutyraldehyde).

At least one amine and aldehyde are present in stoichiometric ratios of 1:1.

This invention further relates to a liquid hydrocarbon combustion fuel comprising:

a major portion of liquid hydrocarbon combustion fuel, preferably any gasoline base stock intended for use in spark-ignition internal combustion engines boiling within the range from about 10 deg. C. to about 220 deg. C. and derived from cracking, reforming, alkylation, polymerization and distillation operations conventionally employed in the petroleum refinery: and, remainder Mannich base which is a condensation product of hydrogenated and distilled Cashew Nut shell Liquid, at least one amine and an aldehyde as prepared by the aforesaid process The said additive is present in an amount ranging from 0.005 to about 1% by Weight, preferably 0.01 to about 0.5% by weight.

The invention will now be described with reference to the foregoing examples.

EXAMPLE 1

Preparation of Mannich base from Hydrogenated CNSL

Mannich condensation products were prepared by the reaction of hydrogenated CNSL (hydrogenation of cashew nut shell liquid was carried out in an autoclave using conventional method of catalytic hydrogenation) and an amine with aqueous formaldehyde substantially according to the following generalized procedure. A mixture of 304 g of hydrogenated CNSL and 90 ml of 37% aqueous formaldehyde and 300 ml ethanol solvent was charged in a one litre reactor equipped with agitator and condenser. Stirred the contents at ambient temperature and slowly added 241 g of Bis(2-ethylhexyl) amine over a period of 30 minutes while maintaining the temperature of the mixture at ambient temperature. The mixture was then heated to reflux with stirring for an additional 6 hrs. and then distilled off the solvent . The trace solvent and unreacted diamine was distilled off under high vacuum at 140–150 deg.C. The reaction product was then cooled and filtered. The total nitrogen content was 2.4 wt. %.

EXAMPLE 2

Same experiment was performed as described in Example-1 but using 1 mole of paraformaldehyde in place of aqueous formaldehyde solution. The total nitrogen content was 2.42 wt %.

EXAMPLE 3

Same experiment was performed as described in Example-1 but changing the amine to dipentylamine. The total nitrogen content was 2.82 wt. %.

EXAMPLE 4

Same experiment was performed as described in Example-1 but changing the amine to di-n-butylamine. The total nitrogen content was 3.04 wt. %.

EXAMPLE 5

Same experiment was performed as described in Example-1 but changing the amine to dicyclohexylamine. The total nitrogen content was 2.67 wt. %.

EXAMPLE 6

Same experiment was performed as described in Example-1 but changing the amine to Primene 81-R. The total nitrogen content was 2.55 wt. %.

The additives prepared above may be employed effectively in any liquid hydrocarbon combustion fuel, preferably any gasoline base stock intended for use in spark-ignition internal combustion engines. The stock may be predominantly olefin rich or aromatic rich or both olefin and aromatic rich in character and may contain hydrocarbon components boiling within the range from about 10 deg. C. to about 220 deg. C., derived variously from cracking, reforming, alkylation, polymerization and distillation operations conventionally employed in a petroleum refinery. The gasoline may additionally contain butanes for vapor pressure control, and various additives to minimize oxidation, gas formation, icing in fuel lines or intake systems, and the like.

Dirty carburetors, containing deposits on throttle plates and other surfaces, can be restored to a clean condition by the use of gasolines of this invention containing from about 0.005 to about 1.0 wt % Mannich base detergent compositions. Generally it is preferred to use from about 0.01 to about 0.5 wt % and most preferably from about 0.01 to about 0.05 wt % of the Mannich base composition on a 100% active basis. Use of a gasoline fuel composition containing this detergent composition at the above concentration levels will also serve to maintain carburetor surfaces and intake valve systems in an especially clean condition.

For the cleanliness of intake valve of the engine a combination of Mannich bases of this invention and a dispersant additive is preferred. The dispersants are the polymeric compounds having high molecular weights. The dispersants used in this invention are of poly-methacrylate class of compounds.

The carrier fluid may be used along with the Mannich condensation product and dispersant already described, particularly where cleanliness in the intake valve system is to be achieved or maintained. Suitable hydrocarbon oil may be used, which is substantially non-volatile and possesses a viscosity at operating conditions not greater than that of a suitable lubricating oil. The carrier fluid could be a mineral oil fraction or an olefin polymer. Suitable mineral oils include the high viscosity index low viscosity and solvent-extracted lubricating oil fractions. Suitable olefin polymers may be used. Other suitable carrier fluids include the alkylated phenolic compounds polyalkylphenols not suitable for Mannich condensation reactions such as trialkyl phenols.

Polyolefin carrier fluids should have number average molecular weights within the range from about 600 to about 3,000, preferably about 600 to about 1,400 (about 40–100 carbon atoms). Preferred carrier fluids include polybutene, having Mn of about 900, and polypropylene, having Mn of about 850.Whenever carrier fluid is employed, it may be added in any amount up to about 300 mg/liter, based on Mannich product (20–40% active), and the amount added will usually depend upon the concentration of Mannich product employed. For example, at low concentrations of Mannich product where only carburetor cleanliness is of concern, little or no carrier fluid is required. However, at the higher dosages of Mannich product used to achieve intake valve cleanliness, a higher weight ratio of carrier fluid is to be preferred.

For ease of handling the Mannich base product or in combination with dispersant and carrier fluid, it is desirable to dilute the material with a light hydrocarbon solvent. An aromatic hydrocarbon, such as xylenes and ethyl benzene are preferred because of their solvency power and compatibility with gasoline fuels.

Evaluation Methodology

Reference gasoline containing FCC naphtha and reformate were used for determining the performance of a series of Mannich bases and additive formulations employing such Mannich base products prepared as described in Examples-1 to 6.

The antioxidant performance was determined by Potential Gum method as per ASTM 873-94 procedure and by Differential Scanning Calorimerty (DSC) using Du Pont Model-910/1090B.

The detergency and dispersancy characteristics of the Mannich bases were evaluated in 100 N base oil using Panel Coker and Lamp Black test methods, respectively. All the Mannich products prepared as described in Example-1 to 6 were also screened for their deposits controlling characteristics using Hot liquid Process Simulator (HLPS) equipment.

Copper corrosion and water reaction characteristics were studied as per ASTM D665-95 (Modified) and ASTM D1094 methods.

Based on the above performance characteristics selected products in combination with dispersant, carrier fluid and diluent solvent were evaluated for Carburetor and Intake System Cleanliness test on twin carburetor Ambassador Engine as per CEC F-04-A-87 test method provided in Bureau of Indian Standards 2796-1995.

Potential Gum (ASTM 873-94 Modified)

This test method determines the tendency of motor gasoline to form gum and deposits under accelerated aging conditions of 4 hrs. In this method 100 ml of the gasoline sample is taken in a bomb and oxygen is introduced to attain the pressure of 100–102 psi. The bomb is then kept in an oxidation bath at 100 deg. C. for four hours. After the completion of the test, bomb is taken out of the bath and cooled rapidly with water and the pressure is released slowly. Evaporation of the sample as per ASTM D-381 gives the value of potential gum. The antioxidant doped gasoline was used as base gasoline and the base gasoline doped with various Munnich bases were evaluated to find out the effect of Mannich bases on the performance of antioxidation properties of base gasoline. The results are as follows:

| Sr. No. | Product | Additive Concentration (wt, ppm) | Pot. Gum mg/100 ml |
|---|---|---|---|
| 1 | Base Gasoline (with antioxidant) | — | 4.0 |
| 2 | Base Gasoline + Mannich product of Example-1 | 20 | 4.1 |
| 3 | Base Gasoline + Mannich product of Example-3 | 20 | 4.2 |
| 4 | Base Gasoline + Mannich product of Example-4 | 20 | 4.0 |

-continued

| Sr. No. | Product | Additive Concentration (wt, ppm) | Pot. Gum mg/100 ml |
|---|---|---|---|
| 5 | Base Gasoline + Mannich product of Example-5 | 20 | 4.1 |
| 6 | Base Gasoline + Mannich product of Example-6 | 20 | 4.0 |

The results showed that addition of Mannich bases to the gasoline does not antagonise the performance of antioxidant present in the gasoline.

Differential Scanning Calorimetry

The DSC (Du Pont Model-910/1090B) was used for relative antioxidant performance evaluation of the products. In this test, the sample (10.5±0.5 mg) taken in a sample boat was subjected to heating from 100–300 deg.C. at the rate of 10 deg C. per minute under an atmosphere of oxygen. The flow of oxygen was maintained between 60–80 cc per minute. The Onset of Oxidation Temperature was adopted as criteria for assessment of antioxidant performance. Results are tabulated as follows:

| Sr. No. | Product | Additive Concentration (% wt) | Onset of oxidation temp. (deg. C.) |
|---|---|---|---|
| 1 | Base oil | — | 174 |
| 2 | Base oil + Mannich product of Example-1 | 1.0 | 204 |
| 3 | Base oil + Mannich product of Example-3 | 1.0 | 186 |
| 4 | Base oil + Mannich product of Example-4 | 1.0 | 189.2 |
| 5 | Base oil + Mannich product of Example-5 | 1.0 | 189.9 |
| 6 | Base oil + Mannich product of Example-6 | 1.0 | 198.4 |
| 7 | Base oil + commercial antioxidant | 1.0 | 198.5 |

The results revealed that all the Mannich products show some degree of antioxidant property.

Detergency Test

In order to determine the detergency characteristics of the products, the Ferdral Test Method Standard No. 791a (method No.3462) and Hot Liquid Process Simulator Rig Test (HLPS-320 test Rig) were used.

a) Panel Coker Test (Fedral Test Method Std. 791A, Method No. 3462)

This method is used for determining the tendency to form coke (solid decomposed products) when in contact with surface at elevated temperature for relatively short periods. In this method 100N base oil doped with 3% of Mannich based product was mechanically splashed for eight hours against a plate at 300 deg.C. and weight of coke deposited was determined. The results were compared with neat 100 N base oil and are tabulated as follows:

| Sr. No. | Product | Additive Concentration (% wt) | Wt. of Coke formed |
|---|---|---|---|
| 1 | Base oil | — | 162.0 mg |
| 2 | Base oil + Mannich product of Example-1 | 3.0 | 102.0 mg |
| 3 | Base oil + Mannich product of Example-3 | 3.0 | 104.7 mg |
| 4 | Base oil + Commercial MFA | 3.0 | 112.3 mg |

The results show that all the Mannich bases have varying degree of detergency characteristics b) HLPS Test Rig This method is used for the screening of detergent/dispersant for gasoline fuel. The sample is added in a fluid reservoir. SS316 heat exchanger tube is fitted and the system is sealed. The system is pressurized to 300 psi of nitrogen. The metering pump pushes the sample through small shell and tube heat exchanger at a constant rate of 3 ml per minute. The fuel inlet temperature tube was kept at 250 deg. C. The test was run for 8 hrs and then the coke deposited on the heat exchanger tube was determined. The results are as follows:

| Sr. No | Sample Description | Additive Concentration (wt, ppm) | Wt of deposits, mg |
|---|---|---|---|
| 1 | Base Gasoline | NIL | 39.3 |
| 2 | Base gasoline + Mannich product of Example-1 | 100 | 10.3 |
| 3 | Base gasoline + Mannich product of Example-3 | 100 | 8.2 |
| 4 | Base gasoline + Mannich product of Example-4 | 100 | 11.3 |
| 5 | Base gasoline + Mannich product of Example-5 | 100 | 10.4 |
| 6 | Base gasoline + Mannich product of Example-6 | 100 | 12.8 |
| 7 | Base oil + Commercial MFA-1 | 100 | 26.7 |
| 8 | Base oil + Commercial MFA-2 | 100 | 13.5 |

It is inferred that addition of Mannich bases decreases the weight of deposits as compared to the base gasoline and the performance of gasoline doped with Mannich bases is much better than gasoline doped with commercial Multifunctional Additives.

Disersancy Test

All the Mannich Products were evaluated for their dispersancy characteristics by Lamp Black test method. In this test method 100 N base oil is doped with 3% of Mannich product. 50 ml of the sample and 1.5 gms of lamp black carbon is kept in a bottle which was subjected to shaking at 60 deg C. for two hours. The contents are immediately filtered by wire mess and Kinematic Viscosity@60 deg C. before and after the test is determined. The percentage increases in K. V. after the test showed the dispersancy characteristics. The results are as follows:

| Sr. No. | Product | Additive Concentration (% wt) | % Rise in Kinematic Viscosity @ 60 deg. C. |
|---|---|---|---|
| 1 | Base oil | — | 36.02 |
| 2 | Base oil + Mannich product of Example-1 | 3.0 | 31.37 |
| 3 | Base oil + Mannich product of Example-3 | 3.0 | 32.6 |
| 4 | Base oil + Mannich product of Example-4 | 3.0 | 35.6 |
| 5 | Base oil + Mannich product of Example-5 | 3.0 | 33.8 |
| 6 | Base oil + Commercial MFA | 3.0 | 23.67 |
| 7 | Base oil + (Mannich product of Example-1 + Dispersant) | 3.0 | 24.61 |

It may be seen from the table that most of the Mannich bases have shown poor dispersancy characteristic which called for addition of a dispersant in the formulation. Formulation containing Mannich bases of this invention and dispersant combination showed good dispersancy in the Lamp Blank test.

Water Reaction of Fuels

This test is designed to measure water tolerance characteristics of gasoline. It is a quick way to measure the ability of a fuel to separate rapidly from water after mixing under low shear conditions. Briefly the procedure involves hand shaking of 80 ml of fuel with 20 ml of phosphate buffer solution for two minutes. After a 5 minutes settling period, the fuel water interface and water layer are rated for emulsion, the fuel phase and clarity. Gasoline with different Mannich bases were evaluated and the results are given as follows:

| Sr. No. | Product | Additive Concentration (wt, ppm) | Test results |
|---|---|---|---|
| 1 | Base Gasoline | — | Pass |
| 2 | Base gasoline + Mannich product of Example-1 | 125 | Pass |
| 3 | Base gasoline + Mannich product of Example-3 | 125 | Pass |
| 4 | Base gasoline + Mannich product of Example-4 | 125 | Pass |
| 5 | Base gasoline + Mannich product of Example-5 | 125 | Pass |

Addition of Mannich bases does not deteriorate the gasoline quality.

Dynamic Corrosion Test

This test is carried out to evaluate the ability of fuels to prevent rusting of ferrous parts when fuel comes in contact with water. Corrosion can lead to severe problems in storage tanks, pipelines tankers and automobile fuel tanks. The particles of rust can also clog fuel lines, filters carburetor orifices or jets. This evaluation procedure is based upon ASTM D-665-95 standard test method for mineral oils with modification so that the test is run at Ambient temperature for fuels. 300 ml of the fuel is stirred at 1000±50 rpm with 30 ml of distilled water for 24 hrs using polished steel spindle conforming to grade 1018 of ASTM A-108 specifications. The test results are as follows:

| Sr. No. | Product | Additive Concentration (wt, ppm) | Test results |
|---|---|---|---|
| 1 | Base Gasoline | — | Pass |
| 2 | Base gasoline + Mannich product of Example-1 | 125 | Pass |
| 3 | Base gasoline + Mannich product of Example-3 | 125 | Pass |
| 4 | Base gasoline + Mannich product of Example-4 | 125 | Pass |
| 5 | Base gasoline + Mannich product of Example-5 | 125 | Pass |

The gasoline quality is not deteriorated on addition of Mannich base products in terms of corrosion.

Engine Test

Based on the foregoing screening tests, a number of Mannich bases were short listed for engine evaluation. Formulations were prepared using Mannich bases, dispersant additives, carrier fluid and diluents. These formulations were evaluated for Carburetor and Intake System Cleanliness test on twin Carburetor Ambassador Engine as per CEC F-04-A-87 test method provided in Bureau of Indian Standards 2796-1995 by visually rating both the carburetor and Intake valve system after 40 hours test run under the following cyclic load conditions simulating stop and go driving:

| Stage | Duration (min) | Speed (rev./min) | Torque Nm | Air Intake, deg C. | Coolent Outlet deg C. | Oil, deg C. | Power, bhp |
|---|---|---|---|---|---|---|---|
| 1 | 0.5 | 550 | — | — | — | — | — |
| 2 | 1.0 | 3000 | 29.5 | 90 max | 92 max | 94 max | 12.6 |
| 3 | 1.0 | 1300 | 24.5 | 90 max | 92 max | 94 max | 4.5 |
| 4. | 2.0 | 1900 | 16.8 | 90 max | 92 max | 94 max | 7.2 |

Data are presented in following Table:

| Sr. No. | Type of Mannich base | Conc. of Mannich base (wt, ppm) | Conc. of Dispersant (wt, ppm) | Conc. of Base Oil (wt, ppm) | Conc. of Solvent (wt, ppm) | Engine Performance Cleanliness (10 = Clean) | |
|---|---|---|---|---|---|---|---|
| | | | | | | Carburetor | Intake Valve |
| 1 | Example-1 | 100 | 100 | 85 | 115 | 9.1 | 8.6 |
| 2 | Example-1 | 125 | 125 | 106 | 144 | 9.8 | 9.2 |
| 3 | Example-3 | 100 | 100 | 85 | 115 | 9.2 | 8.7 |
| 4 | Example-3 | 125 | 125 | 106 | 144 | 9.9 | 9.1 |
| 5 | Base Gasoline | — | — | — | — | 8.5 | 7.8 |

High cleanliness rating of carburetor and intake valve has been observed when Mannich bases of this invention were used in combination with suitable dispersant, carrier fluid and solvent.

We claim:

1. A process for the preparation of Mannich bases from hydrogenated and distilled Cashew Nut Shell Liquid (CNSL) for use as additive in hydrocarbon fuels for removing and protecting build up of deposits on carburetor surfaces and intake valve systems in a gasoline powered engine system comprising:

reacting hydrogenated and distilled Cashew Nut Shell Liquid (CNSL), an amine having at least one reactive hydrogen atom, and an aldehyde in the molar ratio of 1:0.1 to 10:0.1 to 10 at a temperature ranging from 70° C. for 6 to 12 hours in presence of an organic solvent, distilling said solvent and any unreacted amine, and cooling and filtering the reaction product to obtain Mannich base.

2. A process as claimed in claim 1 wherein the solvent and unreacted amine are distilled off under vacuum at 140–150° C.

3. A process as claimed in claim 1 wherein said solvent is protic or aprotic solvents.

4. A process as claimed in claim 3 wherein said protic solvent is alcohol.

5. A process as claimed in claim 3 wherein said aprotic solvent is selected from benzene, toluene, xylene or solvent-refined neutral oil.

6. A process as claimed in claim 1 wherein said amine is selected from the group consisting of primary and secondary alkyl or alkylaryl amine having an alkyl chain ranging from $C_1$ to $C_{20}$ or mixtures thereof.

7. A process as claimed in claim 6 wherein said alkyl chain ranges from $C_4$ to $C_8$.

8. A process as claimed in claim 1, wherein said amine is selected from the group consisting of a mono and di-amino alkane and their substituted analog.

9. A process as claimed in claim 1 wherein the molar ratio of the reactants, Cashew Nut Shell Liquid (CNSL): an amine: an aldehyde is 1.0:1.0–1.2:1.0–1.2.

10. A process as claimed in claim 1 wherein said temperature at which the reaction is carried out is 90° C.

11. A process as claimed in claim 1 wherein said aldehyde is an aliphatic aldehyde.

12. A process as claimed in claim 1 wherein at least one amine and aldehyde are present in stoichiometric ratios of 1:1.

13. A liquid hydrocarbon combustion fuel comprising:

a major portion of liquid hydrocarbon combustion fuel, and remainder Mannich base which is a condensation product of hydrogenated and distilled Cashew Nut Shell Liquid, at least one amine and aldehyde as prepared by the process and claimed in claim 1.

14. A hydrocarbon combustion fuel as claimed in claim 13 wherein said additive is present in an amount ranging from 0.005 to about 1% by weight.

15. A hydrocarbon combustion fuel as claimed in claim 13 wherein said additive is present in an amount ranging from 0.01 to about 0.5% by weight.

16. A process as claimed in claim 8, wherein said substituted analog is a methylamine, ethylamine, dimethylamine, diethylamine, 2-ethylhexylamine, bis(2-ethylhexyl)amine, dimethylaminopropyl amine, diethanol amine, dipentyl amine, dicyclohexylamine, di-n butylamine, phenylenediamine, diaminonaphthalene, morpholine, pyrrole, pryrrolidine, imidazole, imidazolidine, piperidine, or melamine.

17. A process as claimed in claim 1, wherein said aldehyde is formaldehyde, paraformaldehyde, Formalin, acetaldehyde, or aldol (β-hydroxybutyraldehyde).

18. A fuel as claimed in claim 13, wherein the liquid hydrocarbon fuel comprises a gasoline base stock intended for use in spark-ignition internal combustion engines boiling within the range from about 10 deg. C to about 220 deg. C and derived from cracking, reforming, alkylation, polymerization and distillation operations conventionally employed in a petroleum refinery.

* * * * *